United States Patent [19]

Linquist

[11] 4,009,602

[45] Mar. 1, 1977

[54] TUBE BENDING TOOL WITH ANGLE SIGHTING MEANS

[75] Inventor: Wayne A. Linquist, Rockford, Ill.

[73] Assignee: Greenlee Brothers and Co., Rockford, Ill.

[22] Filed: Oct. 14, 1975

[21] Appl. No.: 622,331

[52] U.S. Cl. ..... 72/459; 72/34

[51] Int. Cl.[2] ..... B21D 7/024; B21C 51/00

[58] Field of Search ..... 72/459, 31, 32, 34, 72/35, 37, 310, 319, 149, 457, 458

[56] References Cited

UNITED STATES PATENTS

| | | | |
|---|---|---|---|
| 2,932,225 | 4/1960 | Gardner | 72/459 |
| 3,253,441 | 5/1966 | Benfield | 72/31 |
| 3,590,617 | 7/1971 | Mount | 72/34 |

*Primary Examiner*—C.W. Lanham
*Assistant Examiner*—Gene P. Crosby
*Attorney, Agent, or Firm*—James H. Bower; Mitchell J. Hill

[57] ABSTRACT

A hand bender tool for bending tubes, pipes, conduits and other tubular material, and which is provided with raised indicators on a bending shoe and handle socket that coact with a conical sighting indicator disposed in a position above the shoe, to allow an operator to accurately bend a pipe to a desired angle of bend. A contoured foot treadle is provided with serrations which prevent slippage of the foot of an operator during a bending operation, so as to permit the operator to employ leg power to the fullest advantage.

4 Claims, 4 Drawing Figures

15 30 45

TUBE BENDING TOOL WITH ANGLE SIGHTING MEANS

SUMMARY OF THE INVENTION

This invention relates generally to hand bender tools, and more particularly, to a hand bender tool provided with sighting and angle indicators for making accurate bends in tubes and the like.

Hand bending tools for bending tubes and the like have been provided heretofore with angle-of-bend indicators. One such prior art bending tool employs a swingably mounted pointer. A disadvantage of the last mentioned bending tool is that the pointer may not swing freely because of dirt and other conditions, and it may become easily damaged. Another type of prior art bending tool employs a transparent tube with a rolling ball therein. A disadvantage of the last mentioned bending tool is that the transparent tube can become damaged and the ball lost, and also the ball can become stuck in the transparent tube. In view of the foregoing, it is an important object of the present invention to provide a novel and improved hand bender tool which overcomes the aforementioned disadvantages of the prior art bender tools provided with angle-of-bend indicator means.

It is another object of the present invention to provide a hand bender tool for bending tubes and the like, and which is provided with stationary angle-of-bend raised indicator means which is not subject to damage and which bending tool is simple and compact in construction, light in weight, and efficient in operation.

It is another object of the present invention to provide a tube bending tool which is hand operated and which includes an arcuate shoe against which a tube is bent to form a bend in the tube, a handle attached to the arcuate shoe for rocking the tool on a supporting surface, a tube engaging hook attached to the front end of said shoe, a support structure carried on the front end of said shoe, a sighting indicator mounted on said support structure, and a plurality of angle indicators mounted on the front end of said shoe for selective engagement by operator sight with said sighting indicator during a tube bending operation for making accurate bends in a tube. At least one additional angle indicator may be mounted on a handle socket, for supporting the handle, in a position for operative alignment with the sighting indicator. Arrow indicator means may also be provided for indicating the zero degree position. A foot treadle is operatively mounted on the rear end of the arcuate shoe, and it has an inverted U-shape portion provided with serrations on the top surface, and a connecting portion substantially parallel with the curvature of said shoe, and provided with serrations on the top surface thereof.

It is still another object of the present invention to provide a tube bending tool which includes angular indicator means that permits an operator to make accurate bends in a tube up to 90 degrees.

Other objects, features and advantages of this invention will be apparent from the following detailed description, appended claims, and the accompanying drawings.

DETAILED DESCRIPTION OF THE PREFERRED EMBODIMENT

Figures 2, 3:
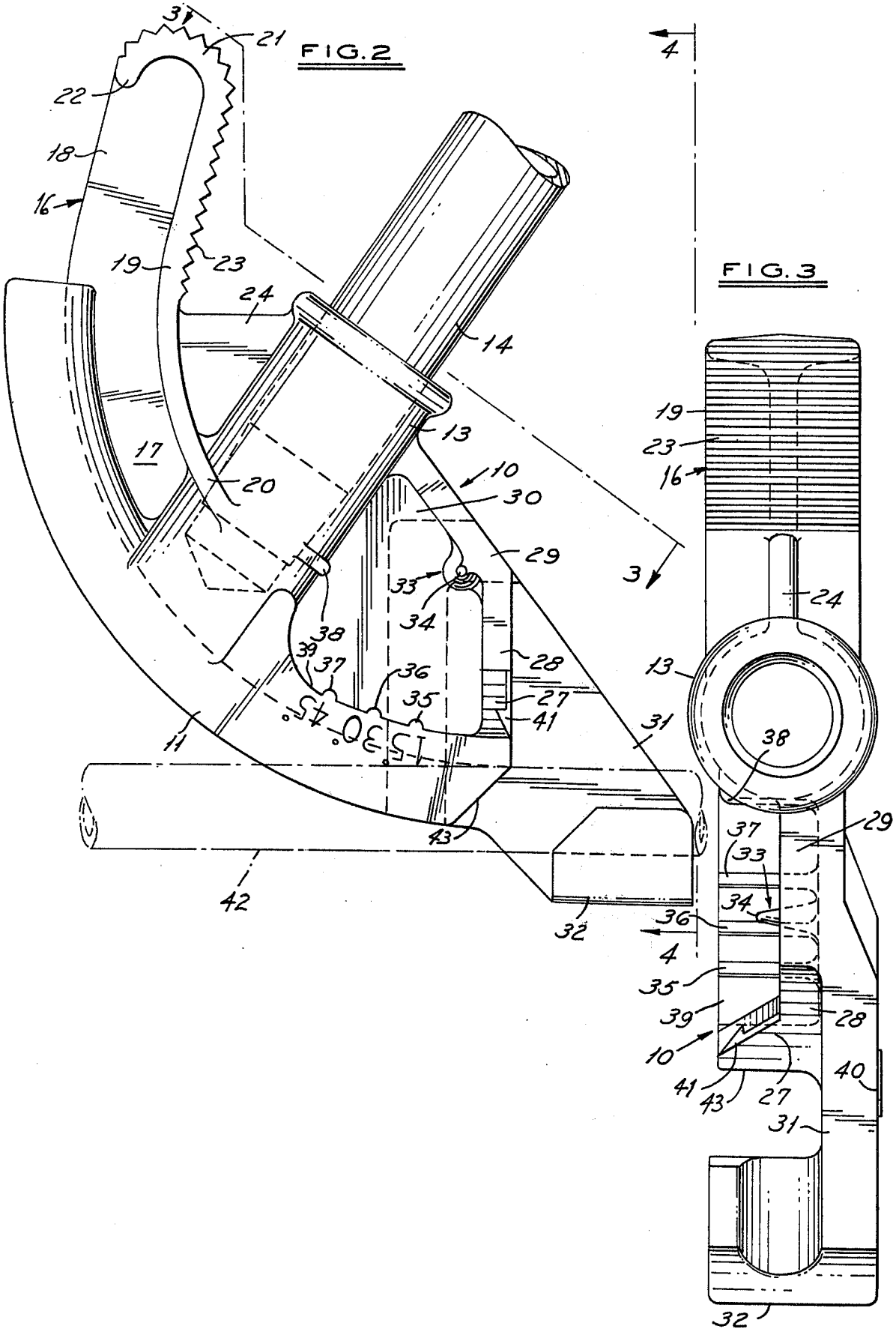
FIG. 2 shows the hand bender tool of the present invention positioned at the beginning of the bend.
FIG. 3 is a top perspective view of the hand bender tool illustrated in FIG. 2, taken along the line 3—3 thereof, looking in the direction of the arrows, and with the handle removed.

Referring now to the drawings, and in particular to FIG. 2, the numeral 10 generally designates a tube and pipe hand bender tool made in accordance with the principles of the present invention. The hand bender tool 10 is preferably formed from a suitable metal, as a high strength aluminum alloy, and it may be made as a one-piece casting. However, it may also be made by other suitable methods. Furthermore, it may be formed in several parts and assembled together, rather than making it as a single casting. It will be understood that the bending tool of the present invention may be used for bending tubing, pipe, conduit and other tubular members. The term "tube" as used herein is intended to include all of the last mentioned types of tubular members.

Figure 1:
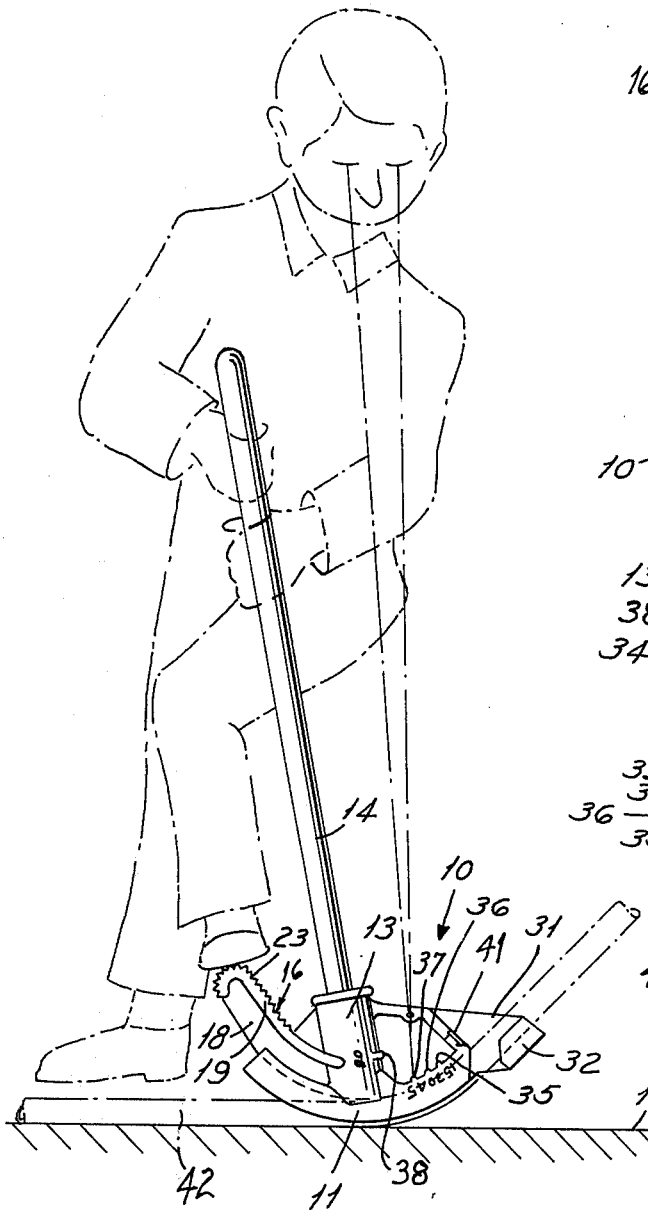
FIG. 1 shows a front elevation view of the tube hand bender tool of the present invention, and with the tool positioned during or at the end of a bend.

As shown in FIG. 2, the tube bending tool 10 is illustrated in its initial position, and it comprises a tube bending base portion or shoe 11 which is formed in a circular arc and which has a concave cross section that opens downwardly. The base portion or shoe 11 functions as a rocker member, and it rocks or pivots on a supporting surface, as a floor 12 as indicated in FIG. 1, during a tube bending operation. The base portion or shoe 11 is integrally joined to a handle socket or shank 13, in which is operatively mounted a suitable operating handle 14.

As best seen in FIG. 2, the tube bending tool 10 is provided with a foot treadle, generally indicated by the numeral 16, on what may be termed the rear end of the shoe 11. The foot treadle 16 includes a supporting web or wall 17 which is integral with the upper side of the shoe 11, and which has its inner end integrally attached to the base of the handle socket 13. The web 17 extends upwardly and outwardly beyond the rear end of the shoe 11, as indicated by the numeral 18. A flange 19 is integrally formed along the upper edge of the web members 17 and 18. The inner end 20 of the flange 19 is integrally attached to the handle socket 13. The upper end of the flange 19 is curved so as to form an inverted U-shaped portion 21 which terminates at the point indicated by the numeral 22. The last mentioned web and flange structure forms a T-shaped in cross section support member which has formed on the upper surface thereof a plurality of continuous serrations or teeth 23 that extend upwardly and around the curved flange portion 21. A reinforcing web or wall 24 is mounted between the flange 19 and the handle socket 13, and it is integrally connected to these members.

Figure 4:
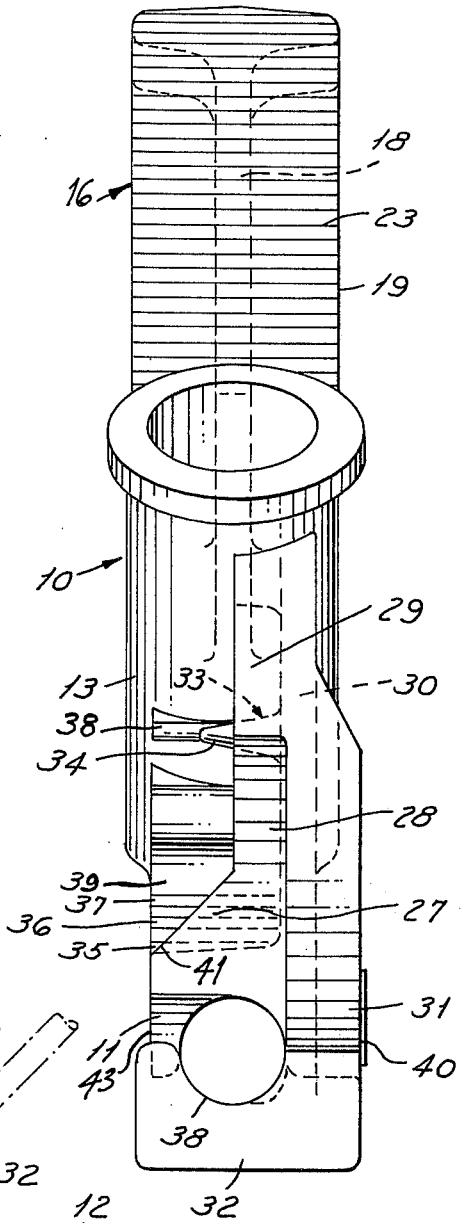
FIG. 4 is a right side elevation view of the hand bender tool illustrated in FIG. 2, taken along the line 4—4 thereof, looking in the direction of the arrows, and with the handle removed.

As best seen in FIGS. 2 and 3, the front end of the base portion or shoe 11 is provided on the upper side with an integral curved flange 39 which has integrally attached at its front end a transverse flange 27. The flange 27 is integrally connected at its upper end to a flange 28 which is substantially perpendicular to the front end of the flange 39, and which extends upwardly toward the handle 14. The upper end of the flange 28 is integral with an angled flange 29 that has its inner end integrally connected to the handle socket 13. The flanges 27, 28 and 29 are supported by a web or wall 30 which is integrally connected thereto, and to the wall socket 13 and arcuate flange 39. Integrally attached to the front outer side of the flange 28 is a wall 31 that has integrally connected on its front end a hook 32. An opening 43 is provided between the front end of the base portion or shoe 11 and the hook 32 to permit insertion of a tube or other tubular material 42 into the hook 32 and into the forward end of the base portion or shoe 11. As best seen in FIGS. 2, 3 and 4, a non-detachable stationary sighting indicator in the form of a conical projection, generally indicated by the numeral 33, is integrally formed on one side of the web or wall 30, and it extends transversely from the plane of the web or wall 30, and parallel to the curved upper surface of the flange 39. The outer pointed end of the non-detachable stationary conical projection 33 is indicated by the numeral 34. Three parallel, raised indicators 35, 36 and 37 are integrally formed on the upper face of the curved flange 39, in laterally spaced apart positions, for indicating angular bends of 15°, 30° and 45°. The bend angle non-detachable stationary indicators 35, 36 and 37 are substantially cylindrical in top plan view, and they are integrally formed with the flange 39. A non-detachable stationary raised member or projection 38 is also integrally formed on the handle socket 13, in a position facing the indicator 33, for indicating a 90° bend, as described more fully hereinafter. The longitudinal axes of the indicators 33, 35, 36, 37 and 38 are parallel with each other. As shown in FIGS. 2 and 3, an arrow indicator 41 is formed on the front face of the flange 27, and it is equivalent to the zero degree position when the bending tool 10 is in the position shown in FIG. 2. A similar arrow indicator 40 for this zero degree position is also formed on the back of the wall 31, as shown in FIG. 3.

The hand bender tool 10 of the present invention is used by positioning the tool as shown in FIG. 1, with the workpiece or tubing 42 in the position shown. The bending tool 10 is shown in the zero degree position, with the arrow 41 being disposed over the operator's guide mark on the tubing 42, at the point where it is desired that the bend is to start. As shown in FIG. 1, the operator places his left foot on the upper curved portion of the foot treadle 16, and grasps the handle 14 and rocks the tool 10 to the left, as viewed in FIG. 1, so as to bring the front end of the tube 42 upwardly to form the desired bend.

As indicated in FIG. 1, the operator has formed a 45° bend in the tubing 42. In order to accurately form a desired bend of the last mentioned angle size, the operator aligns, by eye, the pointed tip 34 of the conical non-detachable stationary sighting indicator 33 with the raised angle indicator 37. The same procedure is followed by aligning the pointed end 34 of the non-detachable stationary sighting indicator 33 with the raised angle non-detachable stationary indicators 35, 36 and 38 to accurately form bends of 15°, 30° and 90°, respectively. The form of the foot treadle 16 provides a wide surface foot engaging surface by means of which the operator can apply additional force or foot pressure during the bending of the tube 42, in addition to the pressure exerted by the operator through the handle 14.

It will be understood that other angles that fall in between the indicated angles may also be quite accurately formed by use of the aforementioned indicators, by approximating the desired angles relative to said indicators. As best seen in FIGS. 2, 3 and 4, the work piece hook 32 is provided with a flat surface on the bottom thereof which provides stability to the hand bender tool. The contoured tooth design on the foot treadle 16 prevents foot slippage and provides positive foot pressure during a bending operation. It will be understood that the hand bender tool 10 may also be used to reverse bend or correct overbends, as desired.

While it will be apparent that the preferred embodiment of the invention herein disclosed is well calculated to fulfill the objects above stated, it will be appreciated that the invention is susceptible to modification, variation and change.

What is claimed is:

1. In a tube bending tool, the combination comprising:

a. an arcuate shoe against which a tube is bent to form a bend in the tube;

b. a handle attached to said arcuate shoe for rocking the tool on a supporting surface;

c. a tube engaging hook attached to the front end of said shoe;

d. a support structure mounted on said shoe;

e. a sighting indicator means cast with said support structure, said sighting indicator means having a non-detachable stationary projection; and, f. a plurality of angle indicators mounted on the front end of said shoe for selective alignment by operator sight with said sighting indicator during a tube bending operation for making accurate bends in a tube.

2. A tube bending tool as defined in claim 1, wherein:

a. a handle socket is attached to said arcuate shoe for attaching said handle to said shoe; and, b. at least one additional angle indicator is mounted on said handle socket in a position for operative alignment with said sighting indicator means.

3. A tube bending tool as defined in claim 2, including:

a. at least one zero degree indicator means mounted on said tool.

4. A tube bending tool as defined in claim 2, including:

a. a foot treadle operatively mounted on the rear end of the arcuate shoe, and having an inverted U-shaped portion provided on the top surface with serrations, and a connecting portion substantially parallel with the curvature of said shoe and provided with serrations on the top surface thereof.

* * * * *